US006406249B1

(12) United States Patent
McAdams et al.

(10) Patent No.: US 6,406,249 B1
(45) Date of Patent: Jun. 18, 2002

(54) FREIGHT CONTAINER, SYSTEM, AND METHOD FOR SHIPPING FREIGHT

(75) Inventors: Allan C. McAdams, Cordova; Bruce Thomas Bullion, III, Memphis; William G. Cummings, Memphis; James Harold Idell, Memphis; Barry J. Atkins, Bartlett; Mark D. Yerger, Collierville, all of TN (US)

(73) Assignee: Federal Express Corporation, Memphis, TN (US)

( * ) Notice: Subject to any disclaimer, the term of this patent is extended or adjusted under 35 U.S.C. 154(b) by 0 days.

(21) Appl. No.: 09/534,037

(22) Filed: Mar. 24, 2000

Related U.S. Application Data

(60) Continuation of application No. 09/232,556, filed on Jan. 15, 1999, now abandoned, which is a division of application No. 08/730,323, filed on Oct. 11, 1996.

(51) Int. Cl.[7] ..... B64D 9/00
(52) U.S. Cl. ..... 414/800; 244/137.1
(58) Field of Search ..... 244/137.1; 414/340, 414/341, 390, 391, 392, 399, 495, 800; 220/1.5; 114/495, 800

(56) References Cited

U.S. PATENT DOCUMENTS

| | | | | |
|---|---|---|---|---|
| 1,577,184 A | | 3/1926 | Fitch | |
| 1,835,133 A | | 12/1931 | Bergen, Jr. | |
| 2,998,948 A | | 9/1961 | Sisk | |
| 3,028,023 A | | 4/1962 | Eckersall | 214/38 |
| 3,206,053 A | | 9/1965 | Bridge | |
| 3,463,532 A | | 8/1969 | Chidley et al. | 262/307 R |
| 3,595,407 A | | 7/1971 | Müller-Kühn | |
| 3,618,999 A | * | 11/1971 | Hlinsky et al. | 296/35 A |
| 3,631,993 A | | 1/1972 | Young | 414/281 |
| 3,741,504 A | | 6/1973 | Alberti et al. | |
| 3,788,683 A | | 1/1974 | Rumell | |
| 3,801,177 A | | 4/1974 | Fylling et al. | |
| 3,861,541 A | * | 1/1975 | Taft et al. | 214/38 C |

(List continued on next page.)

FOREIGN PATENT DOCUMENTS

| | | | |
|---|---|---|---|
| EP | 0 125 035 | | 11/1984 |
| GB | 2 155 442 | | 9/1985 |
| GB | 2 280 171 | | 1/1995 |
| JP | 57160833 | * | 3/1981 |
| WO | WO 91/07337 | | 5/1991 |

OTHER PUBLICATIONS

Ernest H. Robl, *The Intermodal Container FAQ* (last modified Sep. 20, 1997) <http://www.robl.wl.com/Transport/intermod.htm>.

*Primary Examiner*—Thomas J. Brahan
(74) *Attorney, Agent, or Firm*—Finnegan, Henderson, Farabow, Garrett & Dunner, L.L.P.

(57) ABSTRACT

A method of shipping freight directly from a customer's premises to the premises of the consignee. The method includes transporting to a customer's premises at least one freight container. The freight container includes a base, a roof, a pair of opposed side walls, and a pair of opposed end walls. One of the end walls includes an opening for the loading and removal of freight. The container and the opening are sufficiently large to permit the loading and unloading of freight to and from the container by a conventional fork lift truck. The container has a size of approximately 13 feet long, 8 feet high, and 8 feet wide. The method also includes, at the customer's premises, loading freight into the at least one freight container and securing the freight in the freight container. The method further includes transporting the at least one freight container and its loaded freight, in a secured state, from the customer's premises and to the premises of the consignee of the freight.

24 Claims, 13 Drawing Sheets

U.S. PATENT DOCUMENTS 3,966,075 A * 6/1976 Schultz ..... 220/1.5
3,972,437 A 8/1976 Lovich et al. ..... 220/1.5
4,046,277 A 9/1977 Morrison
4,049,135 A 9/1977 Glassmeyer
4,093,084 A 6/1978 Ringer
4,212,406 A 7/1980 Mittelman
4,218,034 A 8/1980 Magill
4,357,059 A 11/1982 Mittelmann ..... 220/1.5 X
4,380,300 A 4/1983 Mountz et al. ..... 220/1.5
4,819,820 A 4/1989 Weiner ..... 220/1.5
4,836,395 A 6/1989 Goutille ..... 220/1.5
4,858,779 A 8/1989 Zimmerlund ..... 220/1.5 X
4,984,962 A 1/1991 Järvinen
5,106,246 A 4/1992 Chance
5,125,700 A 6/1992 Fattori et al. ..... 292/318
5,238,102 A 8/1993 Langer
5,242,070 A 9/1993 Bretschneider et al.
5,265,748 A 11/1993 Furukawa
5,326,212 A 7/1994 Roberts
5,360,129 A 11/1994 Lee
5,378,105 A 1/1995 Palko
5,398,831 A 3/1995 Avramides et al.
5,421,687 A 6/1995 Wayman ..... 414/339
5,449,081 A 9/1995 Sjostedt et al.
5,601,201 A 2/1997 Looker
5,712,789 A 1/1998 Radican ..... 395/229
5,755,175 A 5/1998 White et al. ..... 116/208

* cited by examiner

MD11 PLAN VIEW

DC10 PLAN VIEW

MD11 CONSTANT SECTION

FREIGHT CONTAINER, SYSTEM, AND METHOD FOR SHIPPING FREIGHT

This is a continuation of application Ser. No. 09/232,556, filed Jan. 15, 1999 now abandoned, which is a divisional of pending application Ser. No. 08/730,323, filed Oct. 11, 1996, both of which are incorporated herein by reference.

FIELD OF THE INVENTION

The present invention relates to containers, systems, and methods for shipping freight, and more specifically to containers, systems, and methods for shipping freight of all types from a customer's premise through land vehicles and aircraft to the premise of the consignee, preferably without the need for intermediate repackaging of the freight. The freight container of the present invention can accept freight on standard-sized pallets and has a size and shape which is compatible with a wide variety of standard-sized trucks and aircraft.

DESCRIPTION OF THE RELATED ART

The efficient, safe, and secure shipment of freight, including but not limited to correspondence, materials, goods, components, and commercial products, is an important component in today's business, particularly in view of the international nature of most business enterprises. Freight often is shipped nationally and internationally by means of several different transportation devices, such as trucks, trains, ships, and airplanes. Before the freight reaches its destination, it is often handled by several different entities, such as truck companies, intermediate consolidators, railways, shipping companies, and airlines.

While a number of methods and systems for shipping freight is presently available, the shipment of large volumes of freight typically involves a complex and inefficient transfer and repackaging of freight before it ultimately is received by the consignee. By way of example only, parcels of freight are typically picked up by one entity and brought to a transfer point where the goods are consolidated with other freight into boxes or containers. These boxes and containers, often containing freight of a variety of different customers, are then shipped by land, sea, or air to another site where the parcels of freight are unconsolidated, reloaded, and then delivered to the consignee. Throughout this process, different entities have custodial control of the freight, increasing the prospects of mishandling or error. This complex process results in obvious inefficiencies and expenses. It also increases the prospects for damage to or loss of the freight as it is transported from the customer's premise to the premise of the consignee.

SUMMARY OF THE INVENTION

An object of the present invention is to provide a container, system, and method for shipping freight, particularly large volumes of freight, which represent significant improvements over the prior art.

Another object is to provide a container, system, and method for shipping freight which permits the freight of a particular customer to be loaded at the customer's premise and then secured, and preferably sealed, before it leaves the customer's premise.

Yet another object is to provide a container which can accept and safely hold standard-sized loads-of freight and has a size and shape which is compatible with a wide variety of standard-sized trucks and aircraft.

Still another object is to provide a container, system, and method for shipping freight which permits a single shipper to be solely responsible for the custodial control of the freight from the customer's premises to the consignee.

Additional objects and advantages of the invention will be set forth in part in the description which follows and in part will be obvious from the description, or may be learned by practice of the invention. The objects and advantages of the invention will be realized and attained by means of the elements, methods, and combinations particularly pointed out in the appended claims.

To achieve the objects and in accordance with the purpose of the invention, as embodied and broadly described herein, the invention comprises a freight container for holding and transporting freight, the freight container comprising a base, a pair of opposed side walls, and a pair of opposed end walls, one of said end walls including an opening for the loading and removal of freight, the container and the opening being sufficiently large to permit the loading and removal of freight to and from the container by a conventional fork lift truck, the container having a length of approximately 13 feet.

Preferably the freight container has a door which can close the opening and which can be selectively locked to secure the freight in the box. The container preferably has a height of 8 feet, a width of 8 feet , and can contain at least 12 standard-sized pallets of freight. The container in its preferred form is sized and shaped to fit laterally or longitudinally into a variety of wide-bodied airplanes and longitudinally into a variety of conventional trucks and truck trailers.

The invention further comprises a system for shipping freight from the premise of a customer to the premise of the ultimate recipient by means of transportation including one or more land vehicles, the system comprising an inventory of identical freight containers for holding the freight to be shipped, each container having a length of approximately 13 feet and including a base, a roof, a pair of opposed side walls, a pair of opposed end walls, and an opening formed in one of the end walls. The opening is sufficiently large to permit a conventional fork lift truck to load and unload freight into and out of the container. The one or more land vehicles removably support at least one freight container and transport the at least one container to and from the customer's premise.

In an embodiment of the system of the present invention, the system also includes an aircraft for removably supporting at least one freight container and transporting the at least one freight container from one airport to another. The system also preferably includes locking devices on the vehicle and the aircraft which engage a portion of the freight container and secure the container on the vehicles and/or aircraft, as the containers are being transported. The system also preferably includes scanning or computer devices for placing transactional information regarding the freight and its intended destination into a computer memory, which information can be used to track the freight and ensure that it is properly shipped, insured, and passed through customs or any other governmental or jurisdictional transfer.

In addition, the invention includes a method of shipping freight directly from a customer's premise to the premise of the consignee comprising the steps of transporting to a customer's premises at least one freight container having a base, a roof, a pair of opposed side walls, and a pair of opposed end walls, one of the end walls including an opening for the loading and removal of freight, the container and the opening being sufficiently large to permit the loading and unloading of freight to and from the container by a conventional fork lift truck. At the customer's premise freight is loaded into the at least one freight container and the freight is secured in the freight container. One or more land vehicles transport the at least one freight container from the customer's premise to the premise of the consignee of freight.

The method of the present invention also can include the steps of transporting the at least one freight container and its loaded freight, in a secured state, from the customer's premise to an aircraft and loading one or more of the secured freight container into the aircraft. The aircraft transports the at least one such secured freight container to a designated airport, where the at least one freight container is transferred to a land vehicle for transporting the freight to the consignee.

Preferably, all of the above steps, except the step of loading or unloading the freight container, are performed by a single entity which is responsible for the custody and control of the freight container and any freight in the container during the performance of these steps. In certain methods of the present invention, the freight container, with or without a movable trailer for the container, is left at the customer's premises and placed solely in the customer's custody and control while the customer's freight is loaded into the freight container.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention.

FIGS. 7A through 7G are drawings illustrating the placement of the freight container of the present invention into several different aircraft.

DESCRIPTION OF THE PREFERRED EMBODIMENT

Reference will now be made in detail to the present preferred embodiments of the invention, examples of which are illustrated in the accompanying drawings. Wherever possible, the same reference numbers will be used throughout the drawings to refer to the same or like parts.

Figure 1:
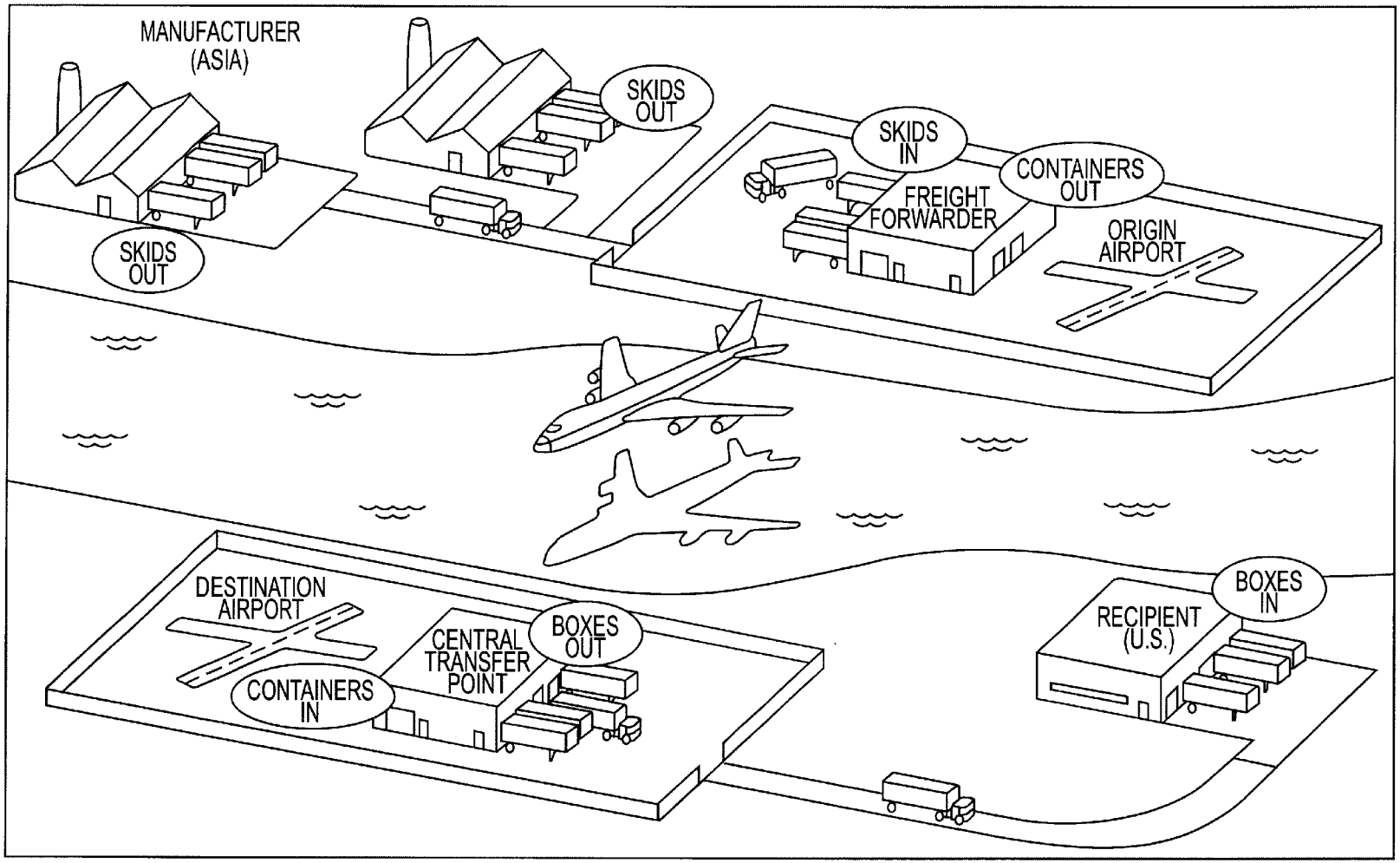
FIG. 1 is a schematic drawing illustrating elements and principles of prior freight transporting systems.

As will be explained in more detail below, the container, system, and method of the present invention represents a significant improvement over present containers systems and methods, where items of freight to be shipped are transported by one entity from a customer's premise to a central area where the items are then consolidated into a larger container, which in turn is transported and later unconsolidated, often by different entities. For example, in conventional systems, as shown in FIG. 1, parcels of freight from a customer are transported to a freight forwarder who in turn takes freight from a variety of different customers at a central location and then sorts and repackages the freight in shipping containers to be transported by land, air, train, or ship to another central transfer point. At that central transfer point, the consolidated freight in the container is removed and sorted and/or repackaged, before it is then transferred to the consignee.

Figure 2:
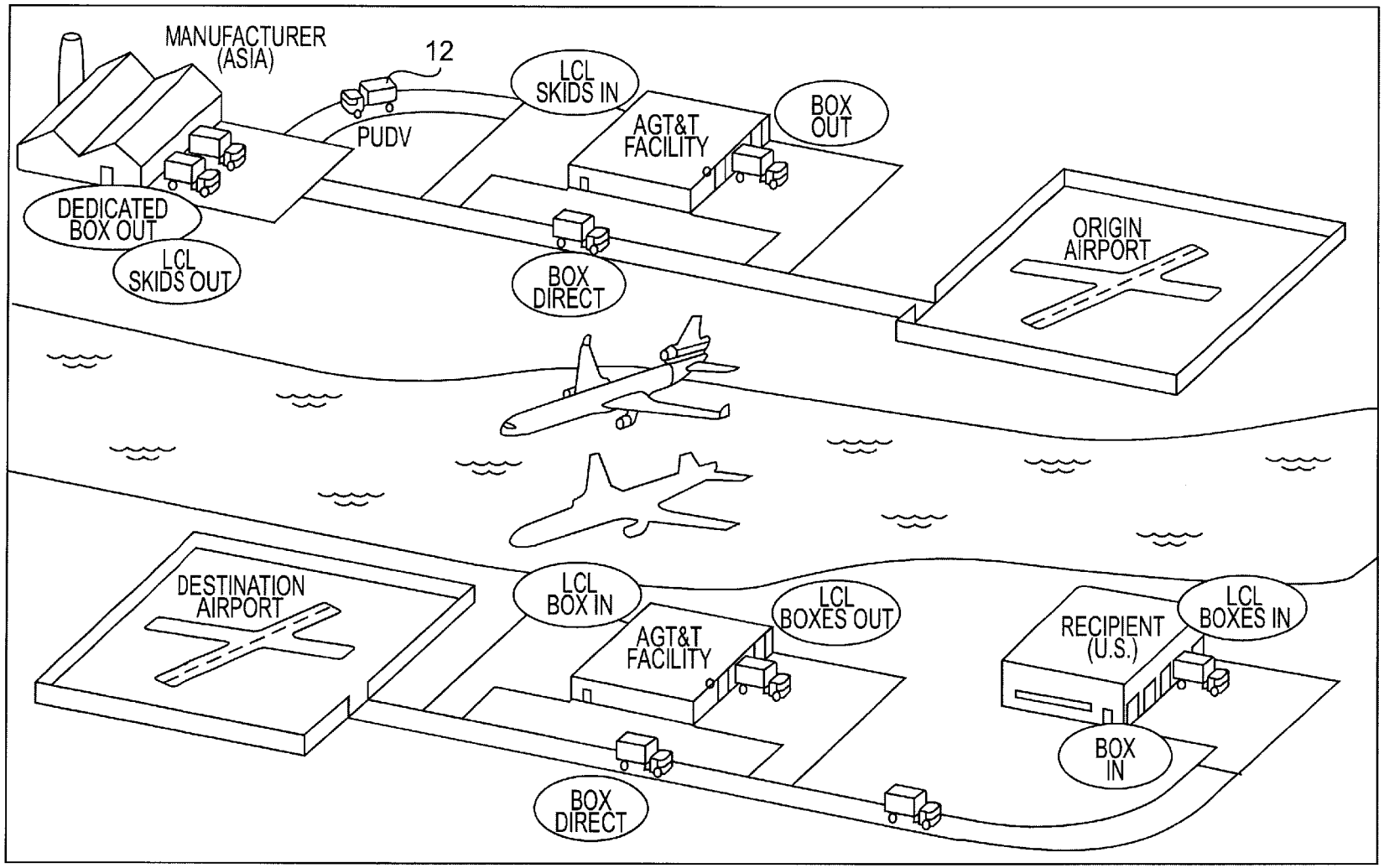
FIG. 2 is another schematic drawing illustrating components and principles of the invention.

In the container, system, and method of the present invention, which is schematically illustrated in FIG. 2, the freight container to be described, by itself, is brought to a customer's premise where it will be loaded, inventoried, locked, and sealed. As shown, the container is transferred to the customer's premise by a truck. The container of the present invention is designed to rest at a customer's loading facility, or alternately with the customer's building, where it will be loaded, using any of a variety of premise loading devices, including fork lift trucks. Alternatively, freight can be loaded by hand into the container. The container is designed to allow a fork lift to go inside the container to position the freight, whether on skids or otherwise packaged, into the freight container.

The freight container preferably is sized and configured to accept the standard size pallet loads and to fit within a wide variety of conventional trucks and aircrafts, without sacrificing efficient loading of the transporting vehicle or aircraft. After the customer's freight is loaded, the freight container can be locked and sealed at the customer's location and most often transferred to the consignee in a locked and sealed state. Consequently, the present invention obviates the need for rehandling and repackaging by a freight forwarder or shipper. Thus, the container can be transported directly from a customer's premises to the consignee by truck, or from a truck to an airport, flown to a different airport, and transferred directly from the other airport to the premise of the consignee.

Figure 2A:
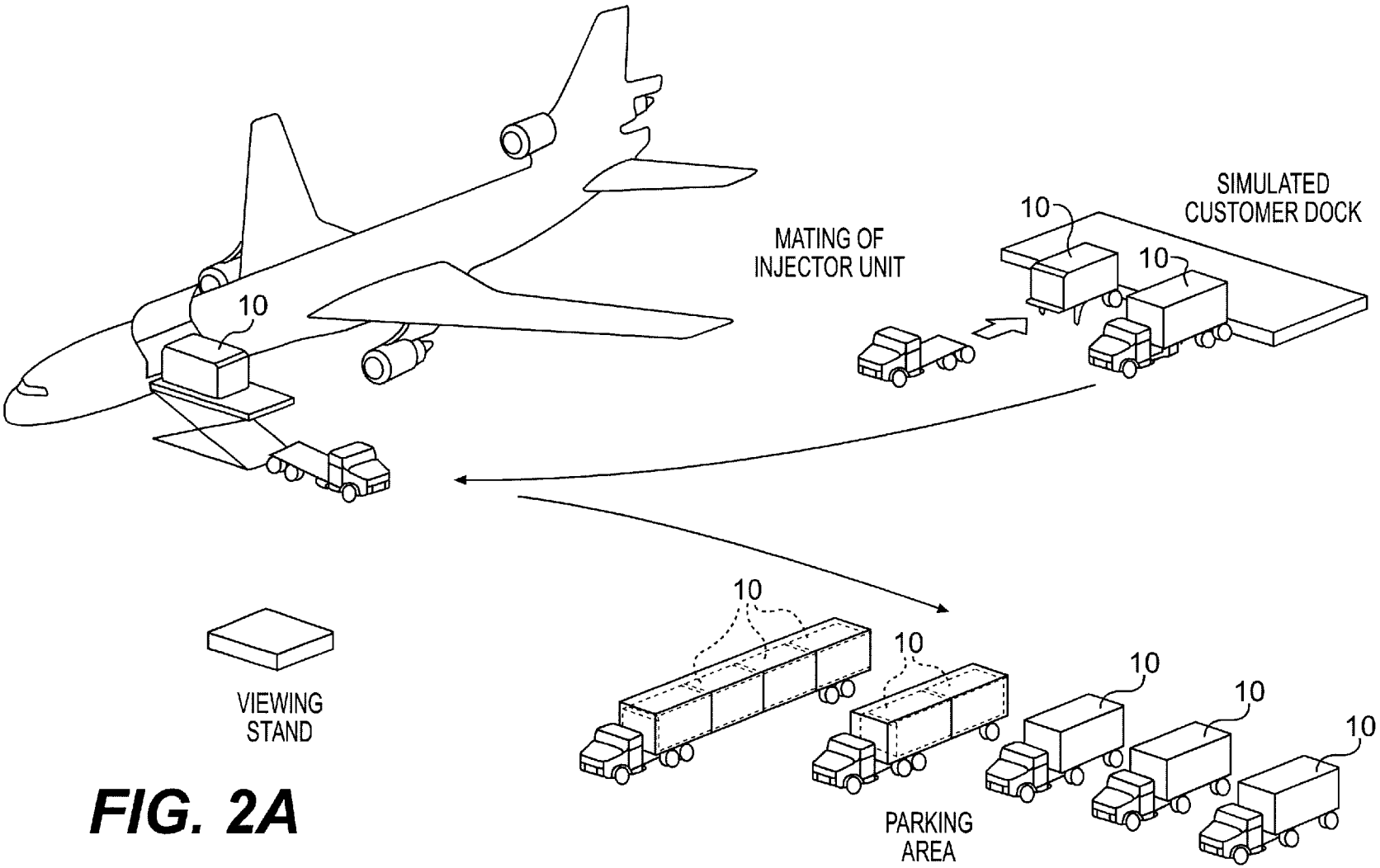
FIG. 2A is a perspective schematic view illustrating airport operations in accordance with the invention.
Figure 3:
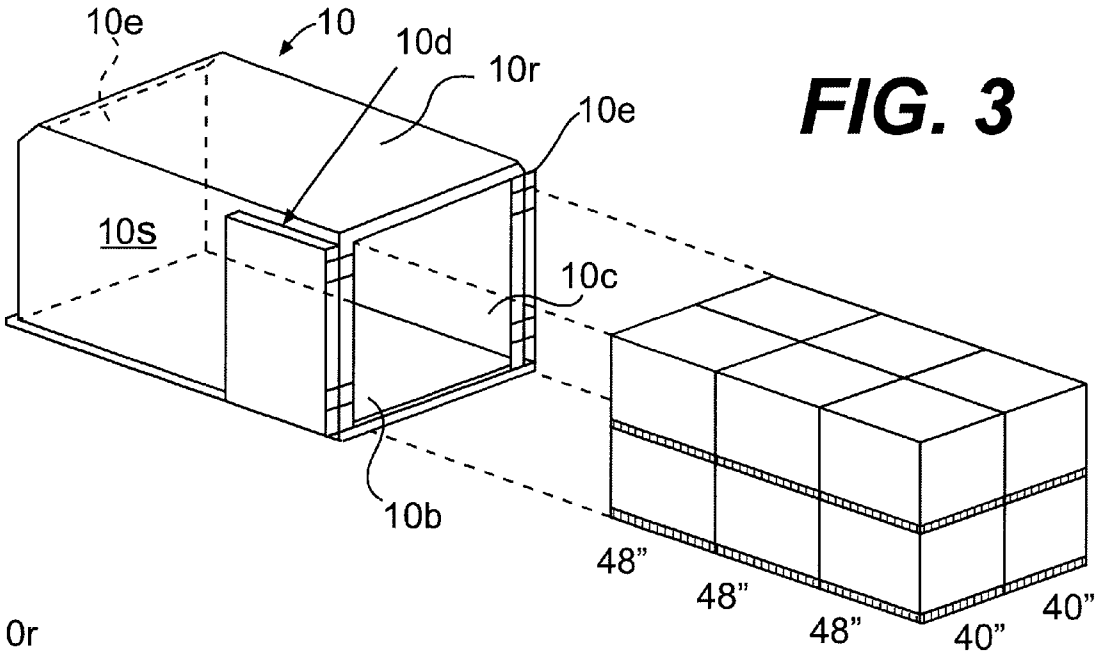
FIG. 3 is an exploded perspective drawing illustrating an embodiment of a freight container of the present invention.
Figure 3A:
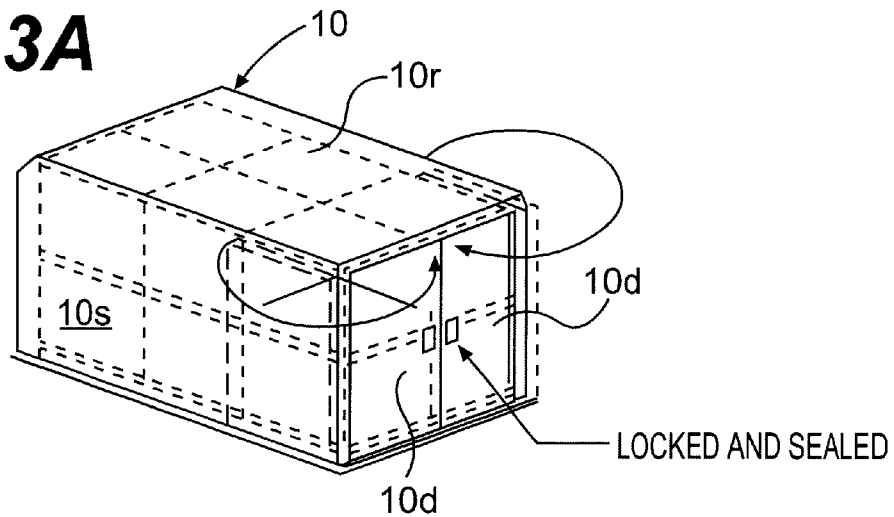
FIG. 3A is a perspective view of the freight container after loading and sealing.

With reference to FIGS. 2A–5 and 8 of the drawings, the freight shipped according to the present invention is securely held throughout the transfer process in an integral container 10 which is sized and configured to accept standard loads of freight and be accepted and efficiently transported by conventional trucks and aircraft. As shown in FIGS. 3 and 3A, the container 10 has a base 10*b* , a roof 10*r*, a pair of opposed side walls 10*s*, and a pair of opposed end walls 10*e*. It preferably has outer dimensions of 13 feet by 8 feet by 8 feet. The container has an opening 10*o* at one end for loading and unloading of freight. The container 10 and the opening 10*o* o are sufficiently large to permit the loading and unloading of freight to and from the container by a conventional fork lift truck. The container also includes doors 10*d* designed to securely close the opening 10*o*, once the freight is loaded, thereby securing the freight within the container. The container also includes a locking feature (not shown), which permits the doors to be locked, thereby preventing unauthorized access to any freight loaded in the container.

Figure 4:
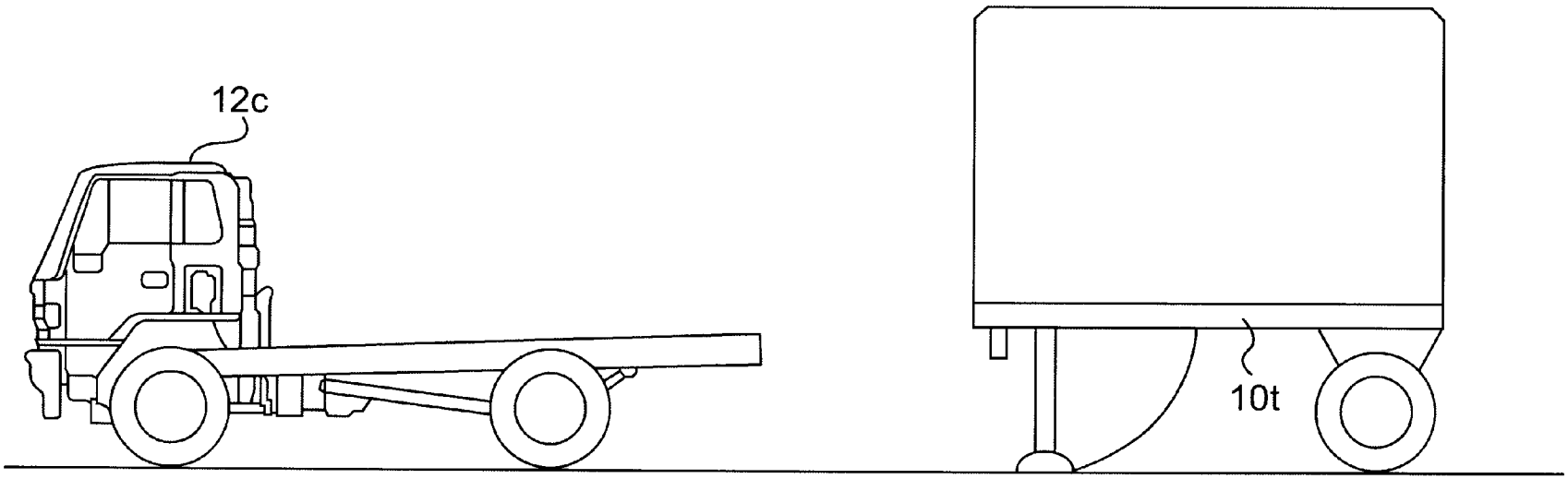
FIG. 4 is an illustration of a truck and removable trailer for transporting the freight container of the present invention to and from a customer's premise.
Figure 5:
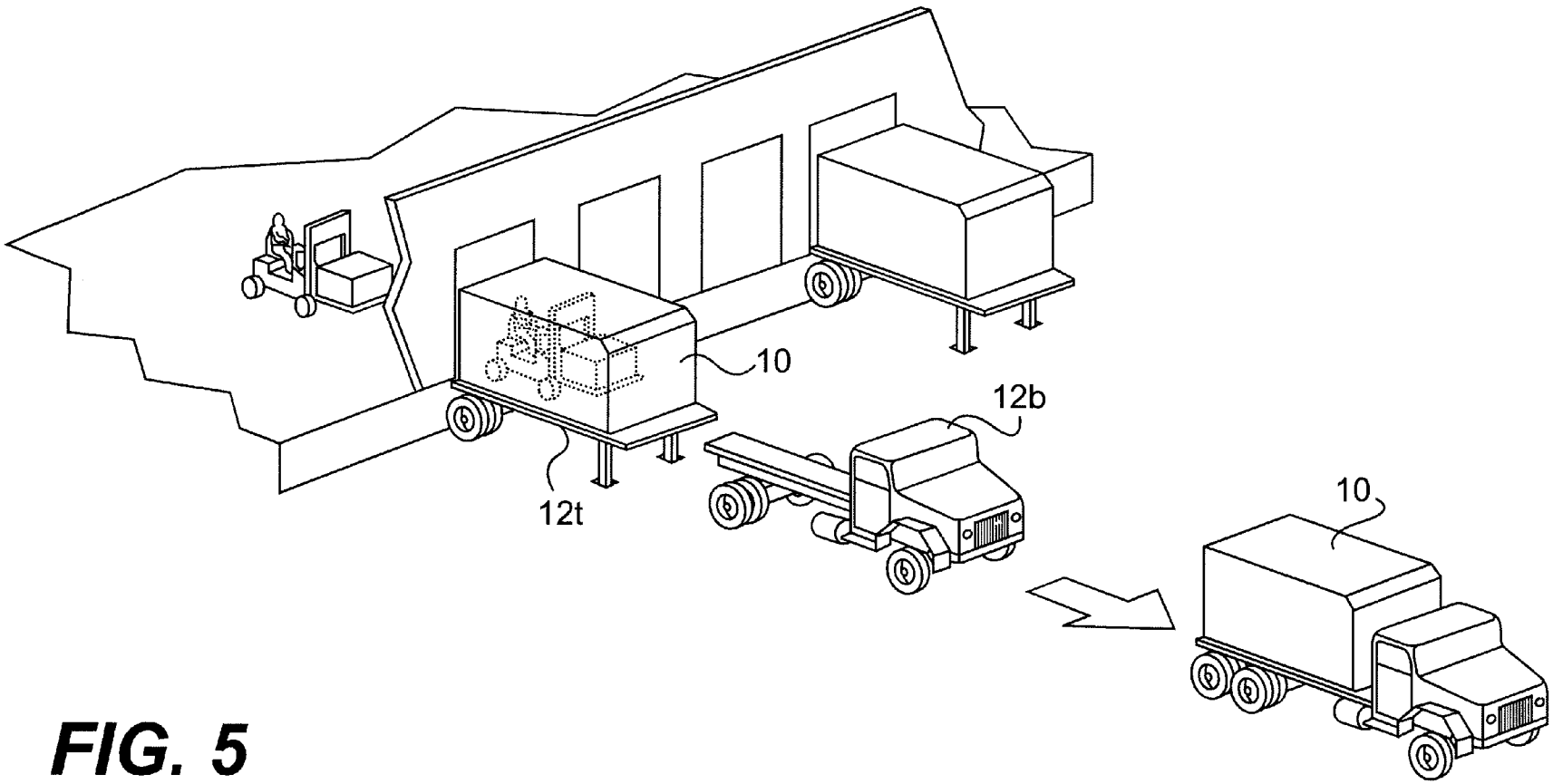
FIG. 5 is a schematic view, in perspective, showing a freight container being loaded by a fork lift and transfer of the loaded container to the truck shown in FIG. 4.

As shown in FIG. 2, the freight container of the present invention is transported directly to a customer's premise by a truck 12, preferably a truck 12 as shown in FIG. 4, having a cab 12*c* and a removable trailer 12*t*. Such a truck, as shown further in FIG. 5, can transport the trailer and container to the customer's premise and then leave the trailer 12*t* and container 10 there, until it has been loaded. Under the principles of the present invention, one or several containers of the present invention can be left at the customer's loading dock or within the customer's premises, so that they can be loaded at the customer's convenience. When the container is loaded, the shipper returns and picks up the container. If the truck shown in FIG. 5 is used, the truck cab can be driven back by the carrier and connected with the truck trailer.

Figure 6A:
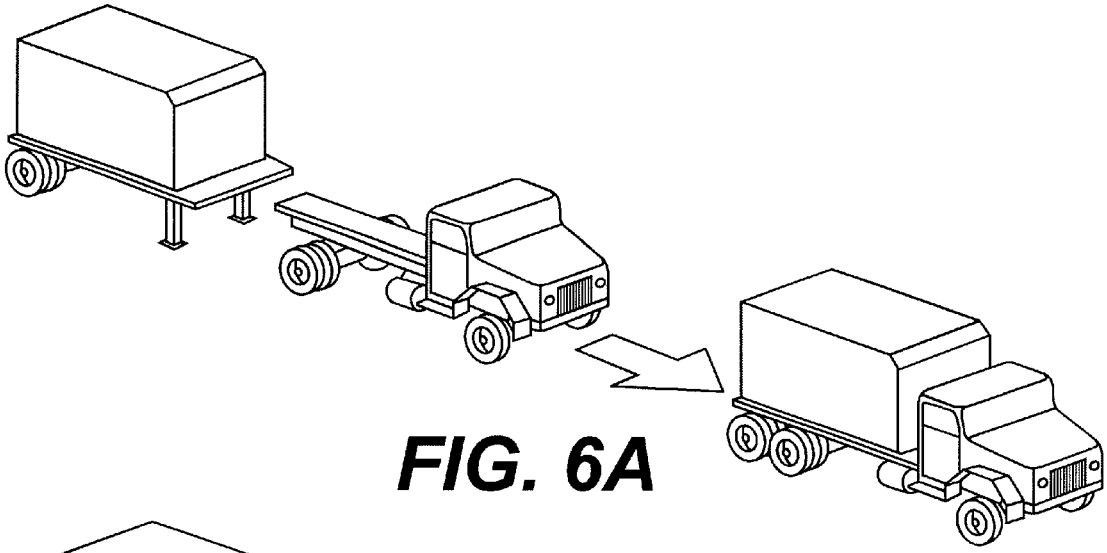
FIGS. 6A through 6C are perspective views of alternative embodiments of the truck shown in FIG. 4.
Figure 6B:
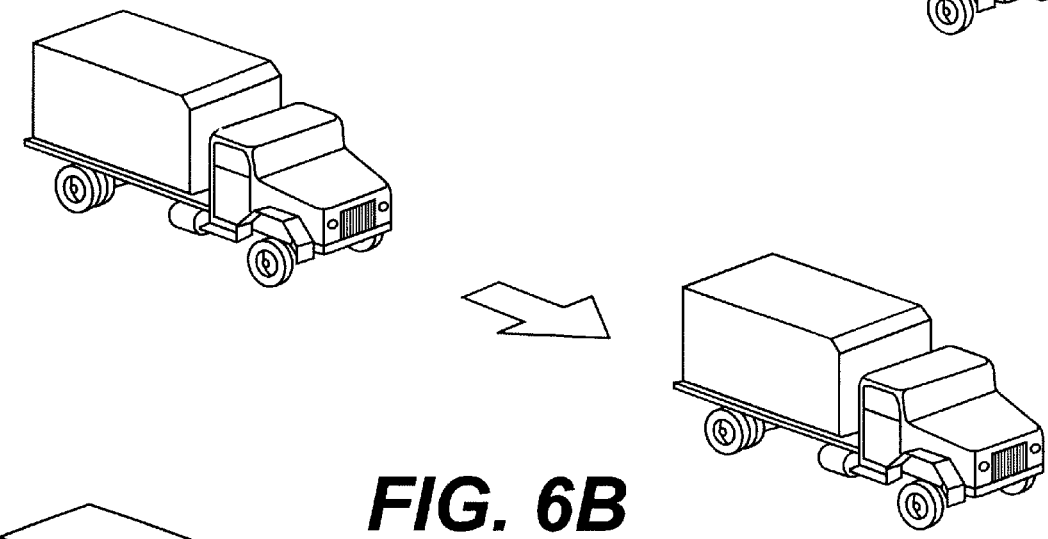
Figure 6C:
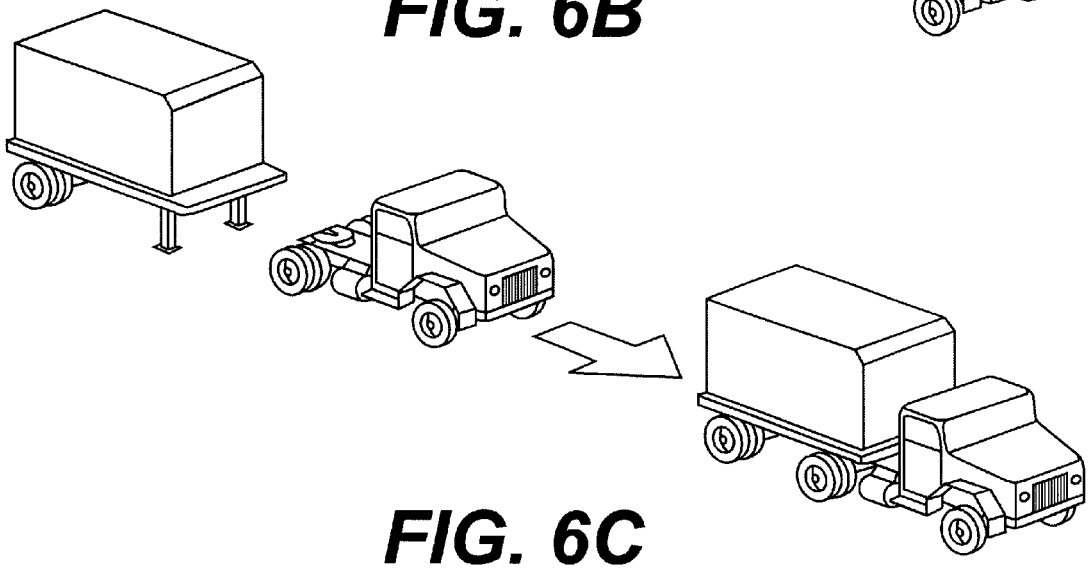

Alternative embodiments of the truck 12 are shown in FIGS. 6B and 6C. In FIG. 6B a flat bed truck is shown whereas in FIG. 6C an articulated truck is shown.

At the customer's premises, the freight of the customer (be it correspondence, paperwork, materials, goods, components, or finished products, or any other type of freight) is loaded into the container. The freight can be loose freight or freight already fixed to standard shipping pallets, such as 40 inch x 48 inch wood pallets as shown in FIG. 3. The freight can be loaded by hand or by conventional loading devices, such as fork lift trucks. The loading can be done by employees of the customer, or by employees or agents of the carrier, depending upon the circumstances and the desire of the customer.

Under the system and'method of the present invention, transactional data regarding the identity, nature, and destination of the freight can be placed into a portable computer device at the customer's premise. This transactional data in turn can be transferred to a central system to track the freight and generate appropriate business and customer documentation. In addition, bar code labels can be placed on the container itself, to permit easy tracking of the freight.

After the freight is loaded into the container and documented, the container is locked. Preferably, a seal is also placed on the locked doors in a manner such that the seal necessarily will be broken if the doors are opened. This aspect of the invention protects the freight and permits full custodial control of the freight to be placed in the hands of a single carrier.

According to the invention, the loaded, locked, and sealed container is then picked up by the carrier and transported to the consignee by the carrier. In some embodiments of the invention, the container is shipped to the ultimate destination, by a common carrier, to the intended consignee by land vehicles only. In that embodiment, the container can be picked up and delivered by the same truck or it can be transferred from a delivery truck (like that shown in FIGS. 4 and 5) to larger trucks (like those shown in FIG. 8) that can contain several containers.

In another embodiment of the present invention, the container is picked up by the shipper's delivery truck and then transferred, directly or indirectly, to an airport, as shown in FIGS. 2 and 2A. There, one or more containers are loaded into an airplane by conventional loading devices, generally depicted in FIG. 2A. The container or containers are placed in the aircraft at selected positions and held in place by locking features, which are discussed more fully below. The airplane and container(s) are then flown to a destination airport 20. At the destination airport, the container(s) are taken off the airplane and transferred to one or more trucks. The containers are then transported by the trucks to the premise of the consignee.

In all embodiments, unless the container must be opened by customs or some other government organization, the container is delivered to the consignee in the same loaded, locked, and sealed condition that it had when it left the customer's premises. Thus, freight shipped by the preferred embodiment of the present invention is kept under the custody and control of a single entity throughout the shipping process.

Figure 7A:
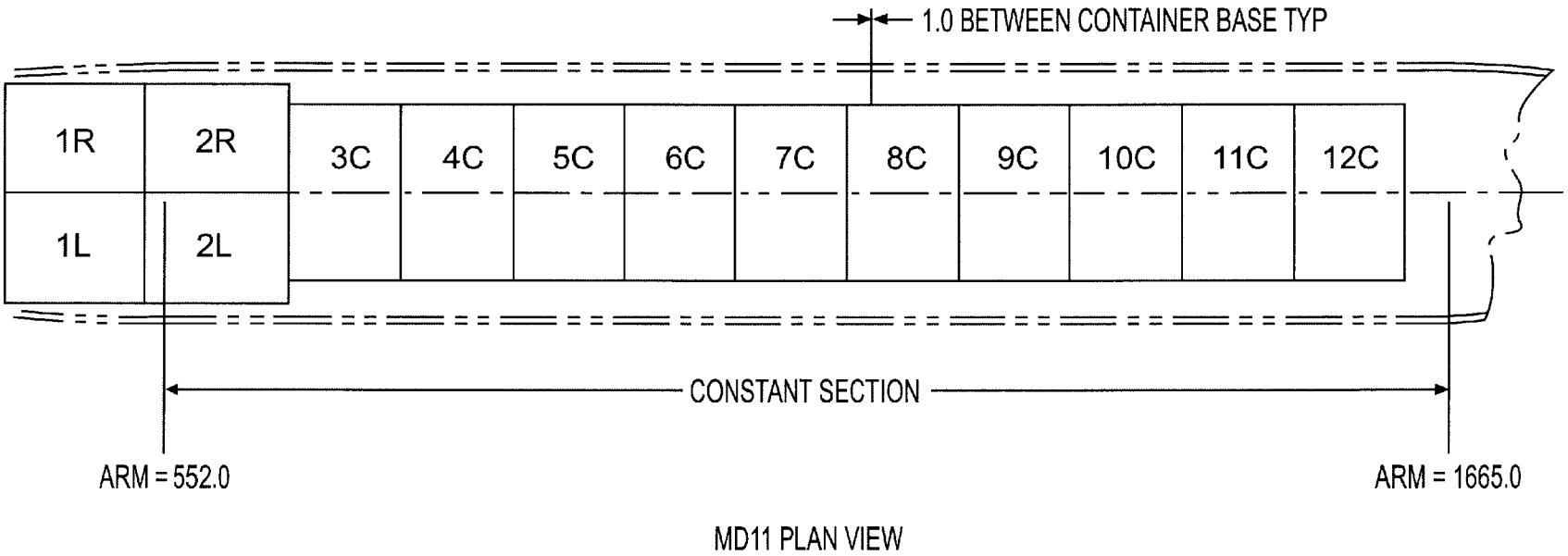
Figure 7B:
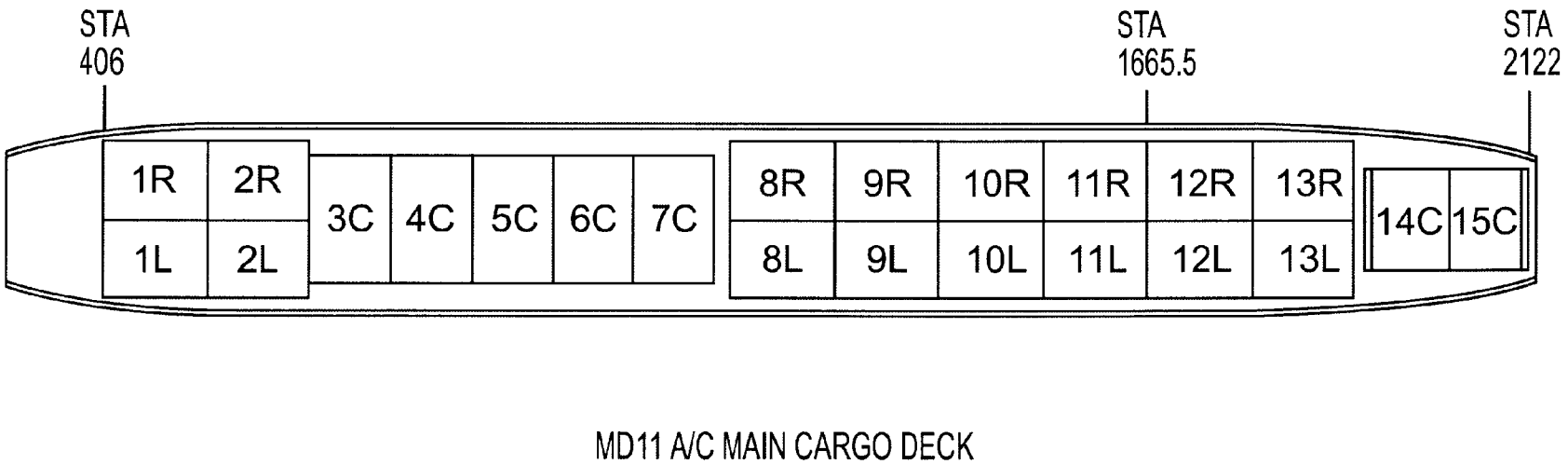
Figure 7C:
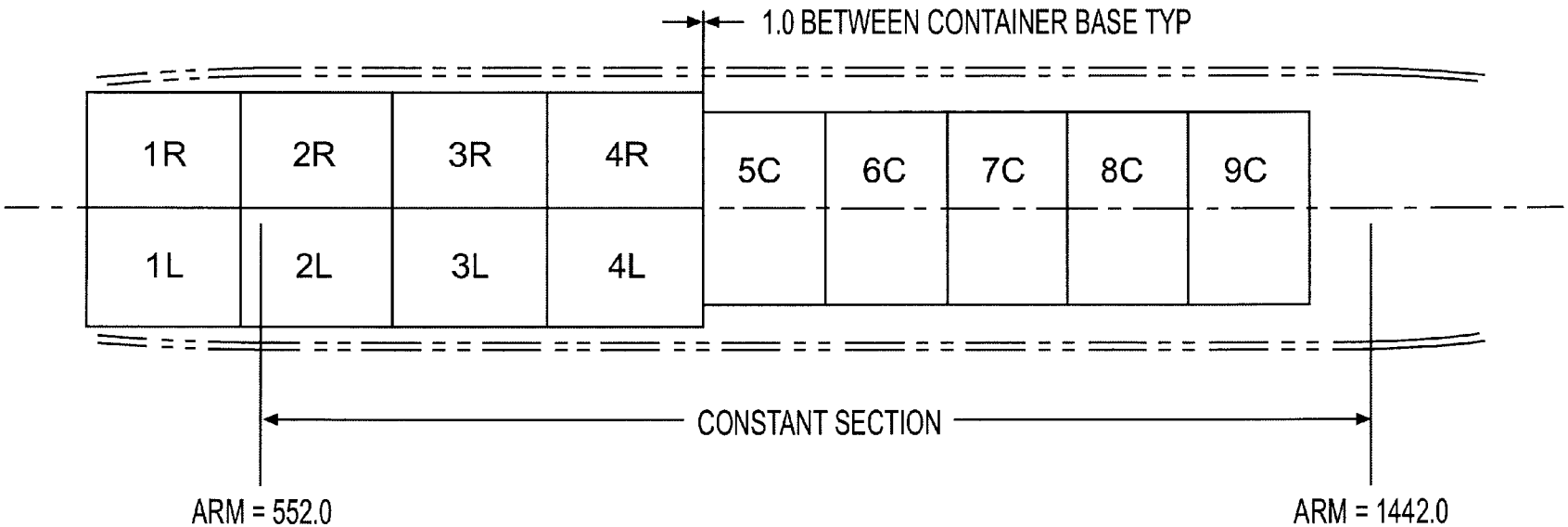
Figure 7D:
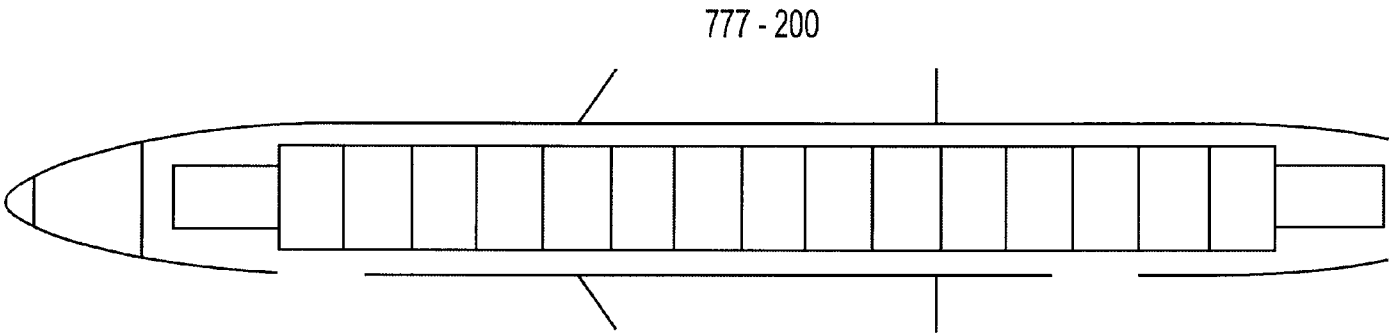
Figure 7E:
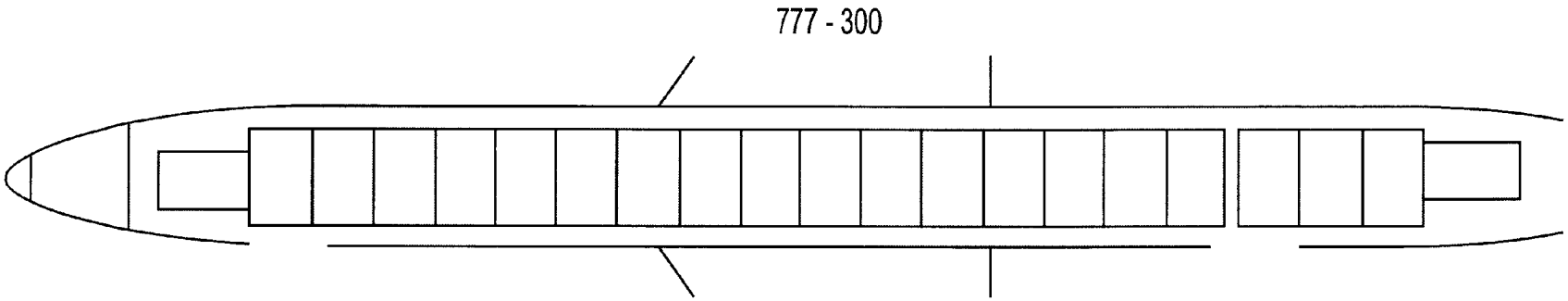
Figure 7G:
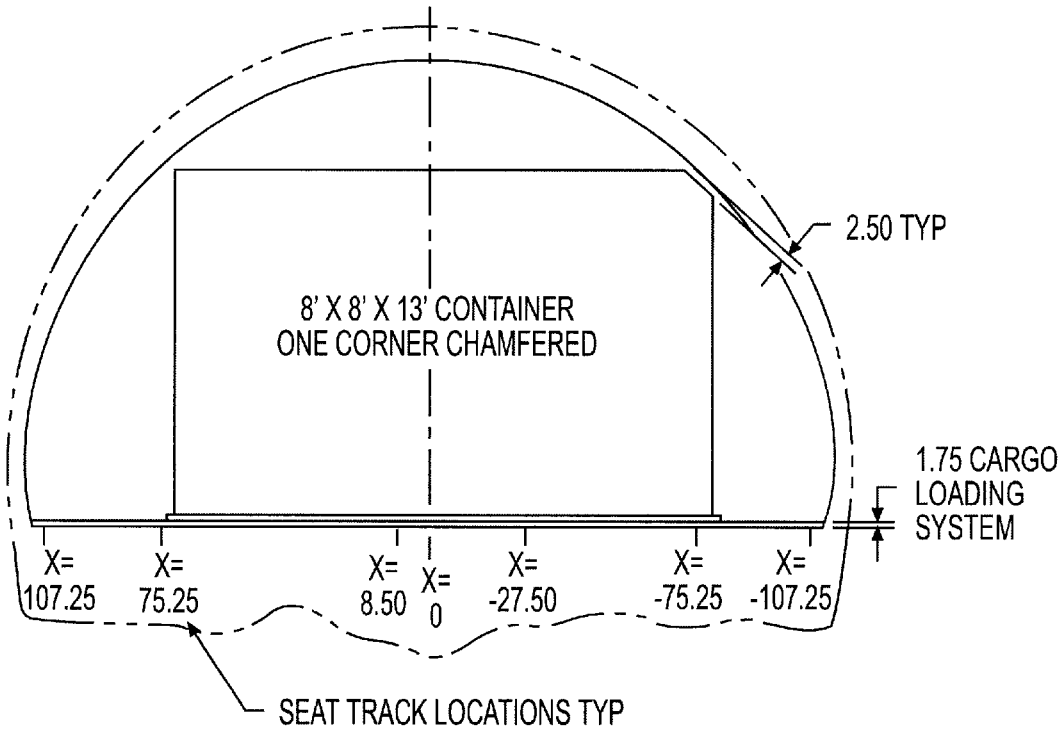
Figure 8:
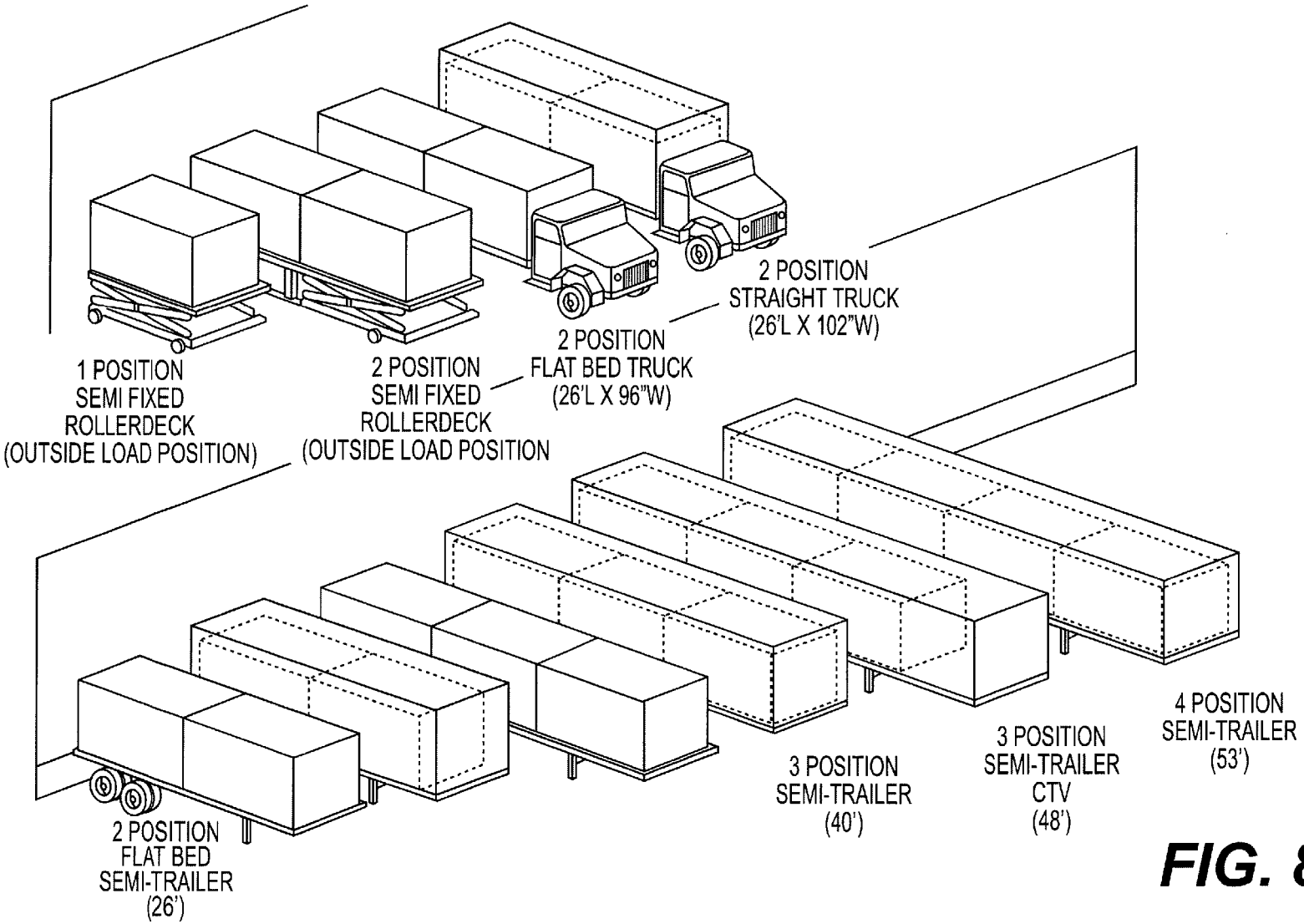
FIG. 8 is a drawing illustrating the placement of the freight container of the present invention into several different trucks.

As generally illustrated in FIGS. 7 and 8, the freight container of the present invention is sized such that it can be held and transported by a variety of different trucks of conventional size, as well as a wide variety of aircraft. The freight container of the present invention was designed to provide an extremely compatible and efficient container relative to a conventional freight loads and means of transferring freight by land, sea, and air.

The physical characteristics of the freight container are designed to serve the purpose of providing a lightweight, yet safe, air container that offers enhanced customer convenience and simplified, efficient handling. The preferred outer dimensions of the container are 8 feet by 8 feet by 13 feet. With these dimensions, each container can accommodate up to 12 standard 40-inch by 48-inch pallets. Six pallets can fit on the floor, six more can be stacked on top of those. The container dimensions further permit the container to be transported by a variety of conventional land vehicles. For example, two containers will fit on a 28-foot truck or trailer, three on a 40-foot, 45-foot, or 48-foot trailer, and four on a 53-foot trailer.

The container can include a variety of different types of doors or security closures. One preferred embodiment of the container will have hinged "barn-type doors" 10*d*. Such an embodiment is shown in FIG. 3A. A wide variety of locking features can be used to lock the doors of the container, once it is loaded. Simple clasp and padlocks could be used, as an example. A single chamfer, designed to fit the contour of the aircraft interior, is located along the intersection of the top surface and the wall opposite the door. As shown in FIG. 7G, this chamfer allows the container to fit laterally within a variety of aircraft.

The container is constructed so that it is airworthy and weatherproof. The walls and doors of the container are constructed so that the container, when closed and locked, is substantially airtight, protecting the freight from adverse environmental conditions.

The base of the container preferably is flat and smooth on the inside and the outside. The flat surface of the container yields two benefits. First, the customer can bring a fork lift or other premise device into the container to load or unload articles. Second, the container is conveyable, and more easily movable on a truck bed or the floor of an aircraft.

The container of the present invention preferably has a tare weight of under 1000 pounds, a freight volume of approximately 777 cubic feet, and a usable payload of at least approximately 10,000 pounds. The container preferably should be made of opaque materials so that the freight within the container cannot be viewed by unauthorized persons. The container can also have insulation and/or an inner liner, to add protection for the freight.

The length, width, and height of the containers are chosen to provide the widest compatibility of the container with conventional trucks and aircraft, while promoting efficiency and economy. As previously explained, the containers are sized to accept freight loaded on standard-sized pallets. The preferred 13 foot length of the container permits the container to be fit laterally (perpendicular to the longitudinal axis of the aircraft) in wide-body aircraft. The height of 8 feet also permits maximum use of space in the aircraft, as long as a chamfer is positioned on the end opposite the door. This relationship is shown in FIG. 7G. The chamfer is cut at a 45° angle and cuts out approximately 9.5 inches of the side and roof at the chamfer.

By means of example, 10 freight containers of the present invention can fit on a MD-11 aircraft, as shown in FIG. 7A. The freight container of the present invention and smaller conventional containers can also be placed on the same aircraft, as shown in FIGS. 7A and 7B (MD-11 aircraft) and FIG. 7C (DC-10). It is estimated that 17 containers of the present invention could fit on a 777-200 (FIG. 7D), 21 on a 777-300 (FIG. 7E), 15 on a 747-400 full freighter (with nose door), 20 on a 747-400 passenger to freighter conversion,25 on a 747-500 full freighter with nose door, 23 on a 747-500 passenger to freighter conversion, 29 on a 747-600 full freighter (with nose door), and 27 on a 747-600 passenger to freighter conversion.

The freight container of the present invention is also compatible with standard trucks for carrying freight. Again, by means of example only, 2 containers fit on a truck with a 28 foot bed, 3 fit on a trailer with 40, 45, and 48 foot beds, and 4 can fit on trailers with 53 foot beds, as shown in FIG. 8.

The construction of the present invention preferably should be made of light weight, strong, and fire resistant materials. While low weight metals such as aluminum can be used to make the containers, other composite materials such as Lexan, carbon-fiber composites, carbon/Kevlar composites, and Kevlar/Spectra composites are preferred. Other known composites for making aircraft bodies and parts also can be used. The container's construction should result in a higher ratio of content weight to container weight. Consequently, the freight in the container will comprise a higher proportion of the gross shipping weight. This allows more freight to be shipped in each aircraft. In addition to providing lighter weight, it is preferred that the container be made of materials having a higher melting point than aluminum.

In the preferred embodiment of the present invention, the beds of trucks for transporting the containers have controllable roller beds in which the rollers can be selectively raised and lowered by pneumatic or hydraulic systems, by means of example. When the rollers are raised, the containers may be easily moved in the bed of the truck with modest force. On the other hand, when the rollers are lowered, the friction between the container and truck will tend to minimize any unwanted movement of the container while it is being transported.

One truck design of the present invention includes a nonarticulating injector concept which employs a cab and chassis truck and a trailer for holding the-freight container. This embodiment is shown in FIGS. 4, 5, and 6A. The truck, which is essentially a cab 12*c* and a flat rail, can back under the trailer 12*t* and pick it up so that the wheels of the trailer become suspended. Once the trailer is hoisted, the legs of the trailer are retracted. Mechanical couplings secure the trailer to the truck. As a result, the truck can drop the container and the trailer at a customer loading, dock and pick it up later, after the customer has loaded it. A preferred embodiment of this truck also will include a roller bed system with retractable rollers, of the type disclosed above.

The container preferably includes a lockdown lip formed along the bottom of each side to enable the container to be fastened to the aircraft floor and truck bed. The lip extends from the container side and end walls and is approximately 0.25 to 0.75 inches thick. The lip preferably will extend between 0.75 inch to 1.5 inches outwardly from the container's end and side walls. Various mechanical locks in the trucks and aircraft can be used to engage the lip and hold the container in place. The present preferred embodiment of the locking features will include mechanical locks secured to the floor of the aircraft, or truck, and designed to selectively engage and lock the lip in place. Conventional locking systems can be used, as long as they are repositioned in the bed of the aircraft to match the outer dimensions of the freight container of the present invention.

The above described container, system, and method of the present invention provide improved customer convenience and shipping efficiency. For example, the freight can be bar coded by the customer or the shipper while it is being loaded and unloaded. As an alternative, a bar code label can be placed on the container itself, after it is loaded. Preferably, other data regarding the freight, and its characteristics, is also documented and placed within a computer system. Preferably, the computer system is a network which is accessible by a customer, so that the customer can utilize the shipper's tracking and processing system. This direct interface between the customer and the carrier will make it possible to expedite the preparation of business documents and the delivery of the manifest to the consignee. Coordination of arrival times will be simpler and faster. Furthermore, the system can be designed to interface with American and foreign customs departments and be capable of creating customs documents.

In a preferred embodiment of the invention, the freight container, once loaded, locked and sealed, will be under the carrier's custody and control through its travel from the customer's premise to the consignee's premise. In international shipment, customer's preclearance can be available for many types of freight, so that the freight container will remain locked and sealed until it reaches its final destination.

It will be apparent to those skilled in the art that various modifications and variations can be made in the container, system, and method of the present invention, and the construction and components of the invention, without departing from the scope or spirit of the invention. It is intended that the specification and examples be considered as explanatory only, with a true scope and spirit of the invention being indicated by the following claims.

What is claimed is:

1. A method of shipping freight directly from a customer's premises to the premises of the consignee comprising the steps of:

a. transporting to a customer's premises at least one freight container comprising a base, a roof, a pair of opposed side walls, and a pair of opposed end walls, one of said end walls including an opening for the loading and removal of freight, said container and said opening being sufficiently large to permit the loading and unloading of freight to and from the container by a conventional fork lift truck, said container having a size of approximately 13 feet long, 8 feet high, and 8 feet wide;

b. at the customer's premises loading freight into said at least one freight container and securing the freight in the freight container;

c. transporting said at least one freight container and its loaded freight, in a secured state, from the customer's premises to the premises of the consignee of the freight.

2. The method of claim 1 further comprising the steps of transporting said at least one container and its loaded freight, in a secured state, to an aircraft and loading one or more of said secured freight container into the aircraft; transporting by aircraft said at least one such secured freight container to a designated airport; and transferring said at least one freight container to a land vehicle.

3. The method of claim 2 wherein each step, other than the step of loading freight into the container, are performed by a single entity which is responsible for the custody and control of the freight container and any freight in the container during the performance of these steps.

4. The method of claim 1 wherein the step of securing the freight in said freight container includes the step of securely locking the freight within a closed freight container.

5. The method of claim 4 wherein the step of securing the freight in the freight container includes the step of placing a seal on the locked container, such that the seal must be broken before the container can be opened and the freight accessed.

6. The method of claim 5 further comprising the step of placing a bar code designation on the freight container before it is transferred from the customer's premises.

7. The method of claim 6 further comprising the step of placing transactional information regarding the freight and its intended destination into a computer memory before the freight container is removed from the customer's premises.

8. The method of claim 1 wherein the step of transporting at least one freight container to a customer's premises includes the step of transferring said freight container to the customer's premises with a truck having a cab and a removable trailer, leaving the removable trailer of the truck and the freight container at the customer's premises while it is being loaded, driving the cab away, and returning and then picking up the removable trailer and freight container after the container is loaded.

9. The method of claim 1 wherein each of steps, other than the step of loading freight into the container, are performed by a single entity which is responsible for the custody and control of the freight container and any freight in the container during the performance of these steps.

10. A method of shipping freight directly from a customer's premises to the premises of the consignee comprising the steps of:

transporting to a customer's premises at least one empty freight container comprising a base, a roof, a pair of opposed side walls, and a pair of opposed end walls, one of said end walls including an opening for the loading and removal of freight, said container and said opening being sufficiently large to permit the loading and unloading of freight to and from the container by a conventional fork lift truck; said container sized to fit laterally within an aircraft and having a length of approximately thirteen feet;

at the customer's premises loading freight into said at least one freight container;

securing the freight in the freight container;

transporting said at least one freight container and its loaded freight, in a secured state, from the customer's premises to the premises of the consignee of the freight; and wherein each of the steps, other than the step of loading freight into the container, are performed by a single entity which is responsible for the custodial control of the freight container and any freight in the container during the performance of these steps.

11. The method of claim 10 wherein transporting said at least one freight container and its loaded freight, in a secured state, from the customer's premises to the premises of the consignee of the freight further includes transporting said at least one container and its loaded freight, in a secured state, to an aircraft and loading said at least one freight container into the aircraft; transporting by aircraft said at least one freight container to a designated airport; and transferring said at least one freight container to a land vehicle.

12. The method of claim 10 wherein securing the freight in said freight container includes securely locking the freight within the freight container.

13. The method of claim 12 wherein securing the freight in the freight container includes placing a seal on the locked container, such that the seal must be broken before the container can be opened and the freight accessed.

14. The method of claim 13 further comprising placing a bar code designation on the freight container before it is transferred from the customer's premises.

15. The method of claim 14 further comprising placing transactional information regarding the freight and its intended destination into a computer memory before the freight container is transported from the customer's premises.

16. The method of claim 10 wherein transporting at least one freight container to a customer's premises includes transferring said freight container to the customer's premises with a truck having a cab and a removable trailer, leaving the removable trailer of the truck and the freight container at the customer's premises while it is being loaded, and driving the cab away.

17. The method of claims 16 further comprising picking up the removable trailer and freight container with the truck after the container is loaded.

18. A method of maintaining custodial control of freight by a carrier during shipping between a customer's premises and the premises of the consignee comprising the steps of:

transporting to the customer's premises at least one freight container comprising a base, a roof, a pair of opposed side walls, and a pair of opposed end walls, one of said end walls including an opening for the loading and removal of freight, said container and said opening being sufficiently large to permit the loading and unloading of freight to and from the container by a conventional fork lift truck, said container having a length of approximately thirteen feet;

loading the freight into said at least one freight container;

securing the freight inside said at least one freight container;

placing a seal on said at least one freight container to indicate tampering with the contents of the freight container; and transferring said at least one freight container and said loaded freight from the customer's premises to the consignee's premises under the custodial control of the carrier.

19. The method of claim 18 wherein transporting to the customer said at least one container, the container further comprises a chamfer in the end wall opposite the opening allowing said container to fit laterally within an aircraft.

20. The method of claim 19 wherein transferring said at least one freight container and said loaded freight from the customer's premises to the consignee's premises under the custodial control of the carrier includes transferring said at least one freight container and said loaded freight from the customer's premises to an aircraft; said aircraft transferring said at least one freight container and said loaded freight to a destination airport; transferring said at least one freight container and loaded freight to a land vehicle; and transporting said at least one freight container and loaded freight to the consignee's premises with a land vehicle.

21. The method of claim 20 wherein transferring said at least one freight container and said loaded freight from the customer's premises to the aircraft includes orienting said at least one freight container laterally within said aircraft.

22. The method of claim 19 further comprises securing said at least one freight container to the land vehicle and aircraft, said at least one freight container further comprising a lip extending from one of said opposed side walls to secure the container to the land vehicle and the aircraft.

23. The method of claim 18 wherein transporting at least one freight container to a customer's premises includes transferring said freight container to the customer's premises with a truck having a cab and a removable trailer, leaving the removable trailer of the truck and the freight container at the customer's premises while it is being loaded, and driving the truck away.

24. The method of claims 23 further comprising picking up the removable trailer and freight container with the truck after the container is loaded.

* * * * *

UNITED STATES PATENT AND TRADEMARK OFFICE

CERTIFICATE OF CORRECTION

PATENT NO. : 6,406,249 B1
DATED : June 18, 2002
INVENTOR(S) : McAdams et al.

It is certified that error appears in the above-identified patent and that said Letters Patent is hereby corrected as shown below:

Title page,
"13 Drawing Sheets" should read -- 14 Drawing Sheets --.

Drawings,
Fig. 7F should appear as follows:

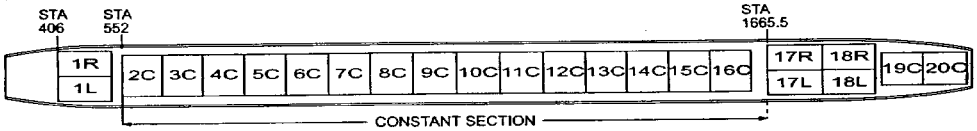

MD-XX PLAN VIEW

*FIG. 7F*

Column 10,
Line 30, "claims 16" should read -- claim 16 --.

Column 12,
Line 8, "claims 23" should read -- claim 23 --.

Signed and Sealed this

Fourteenth Day of January, 2003

JAMES E. ROGAN
*Director of the United States Patent and Trademark Office*